US010354587B2

(12) United States Patent
Kim et al.

(10) Patent No.: US 10,354,587 B2
(45) Date of Patent: Jul. 16, 2019

(54) DISPLAY DEVICE

(71) Applicant: SAMSUNG DISPLAY CO., LTD., Yongin-si, Gyeonggi-do (KR)

(72) Inventors: Kwanghun Kim, Geoje-si (KR); Hyunsik Kim, Hwaseong-si (KR); Wonsup Choi, Asan-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 8 days.

(21) Appl. No.: 15/164,774

(22) Filed: May 25, 2016

(65) Prior Publication Data

US 2016/0351129 A1 Dec. 1, 2016

(30) Foreign Application Priority Data

May 29, 2015 (KR) ..... 10-2015-0076034

(51) Int. Cl.

| | |
|---|---|
| ***G09G 3/32*** | (2016.01) |
| ***G09G 3/30*** | (2006.01) |
| ***G09G 3/3258*** | (2016.01) |
| ***G09G 3/20*** | (2006.01) |

(52) U.S. Cl.

CPC ..... *G09G 3/3258* (2013.01); *G09G 3/20* (2013.01); *G09G 2370/08* (2013.01)

(58) Field of Classification Search

CPC ..... G09G 3/20; G09G 2370/08; G09G 3/32–3291

USPC ..... 345/99

See application file for complete search history.

(56) References Cited

U.S. PATENT DOCUMENTS

| | | | | |
|---|---|---|---|---|
| 8,074,125 | B2 | 12/2011 | Lee | |
| 8,149,253 | B2 | 4/2012 | Lee | |
| 8,847,941 | B2 | 9/2014 | Tanaka et al. | |
| 2005/0264696 | A1* | 12/2005 | Ozawa | G09G 5/008 348/537 |
| 2013/0278581 | A1* | 10/2013 | Al-Dahle | G09G 3/3648 345/212 |
| 2014/0312908 | A1* | 10/2014 | Lemons | G09G 3/006 324/414 |

(Continued)

FOREIGN PATENT DOCUMENTS

| | | | |
|---|---|---|---|
| JP | 2010-107933 | A | 5/2010 |
| JP | 2012-230168 | A | 11/2012 |

(Continued)

OTHER PUBLICATIONS

US 9,165,492 B2, 10/2015, Kimura et al. (withdrawn)

*Primary Examiner* — Stephen G Sherman

(74) *Attorney, Agent, or Firm* — Lewis Roca Rothgerber Christie LLP

(57) ABSTRACT

There is provided a display device including a display panel, a plurality of data drivers configured to apply a data voltage to the display panel and to output a feedback signal indicating a driving status, a shared back channel configured to receive the feedback signal from the plurality of data drivers, a virtual feedback signal circuit configured to output a virtual feedback signal indicating a normal driving state of the plurality of data drivers, a timing controller configured to apply a data signal to the plurality of data drivers, and a switch connected to the timing controller, and configured to selectively connect the shared back channel or the virtual feedback signal circuit to the timing controller.

17 Claims, 8 Drawing Sheets

(56) References Cited

U.S. PATENT DOCUMENTS

| | | | | |
|---|---|---|---|---|
| 2015/0035817 | A1* | 2/2015 | Hwang | G09G 3/20 345/212 |
| 2015/0310824 | A1* | 10/2015 | Yang | G09G 5/006 345/213 |
| 2016/0104418 | A1 | 4/2016 | Keum et al. | |

FOREIGN PATENT DOCUMENTS

| | | | |
|---|---|---|---|
| KR | 10-0661828 | B1 | 12/2006 |
| KR | 10-0868299 | B1 | 11/2008 |
| KR | 10-2011-0093450 | A | 8/2011 |
| KR | 10-2016-0033816 | A | 3/2016 |
| KR | 10-2016-0043158 | A | 4/2016 |

* cited by examiner

DISPLAY DEVICE

CROSS-REFERENCE TO RELATED APPLICATION

This application claims the priority to, and the benefit of, Korean Patent Application No. 10-2015-0076034, filed on May 29, 2015, with the Korean Intellectual Property Office ("KIPO"), the disclosure of which is incorporated herein in its entirety by reference.

BACKGROUND

1. Field

Aspects of embodiments of the present invention relate to a display device using a plurality of drivers connected to a timing controller.

2. Description of the Related Art

With advances toward an information-oriented society, a need has arisen for flat panel display ("FPD") devices that have excellent characteristics, such as slimness, light weight, low power consumption, and the like. Among different types of the FPD devices, an organic light emitting diode ("OLED") display device is a self-emission-type display device that displays an image using OLEDs that emit light. By virtue of its excellent characteristics, such as low power consumption, high luminance, high response speed, and so forth, the OLED display devices have drawn attention as display devices of the next generation.

It is to be understood that this background section is intended to provide useful background for understanding the technology, and as such, the technology background section may include ideas, concepts or recognitions that were not part of what was known or appreciated by those skilled in the pertinent art prior to a corresponding effective filing date of subject matter disclosed herein.

SUMMARY

Aspects of embodiments of the present disclosure are directed to a display device having an inspection mode in which a data driver experiencing an error may be verified using a virtual feedback signal.

According to some embodiments of the present invention, there is provided a display device including: a display panel; a plurality of data drivers configured to apply a data voltage to the display panel and to output a feedback signal indicating a driving status; a shared back channel configured to receive the feedback signal from the plurality of data drivers; a virtual feedback signal circuit configured to output a virtual feedback signal indicating a normal driving state of the plurality of data drivers; a timing controller configured to apply a data signal to the plurality of data drivers; and a switch connected to the timing controller, and configured to selectively connect the shared back channel or the virtual feedback signal circuit to the timing controller.

In an embodiment, the timing controller is further configured to output, to the switch, a control signal for connecting the switch to the virtual feedback signal circuit when the display device is in an inspection mode.

In an embodiment, the timing controller is further configured to output, to the switch, a control signal for connecting the switch to the virtual feedback signal circuit when a low signal of the shared back channel is maintained for a reference time or longer.

In an embodiment, the timing controller is configured to transmit, to the data driver, the data signal including modulating clock data and image data.

In an embodiment, the data driver further includes a feedback signal circuit configured to receive the data signal output from the timing controller and to output the feedback signal.

In an embodiment, the feedback signal circuit is configured to output a normal state feedback signal to the shared back channel when the data driver is in a clock locking state.

In an embodiment, the feedback signal circuit is configured to output an error state feedback signal to the shared back channel when the data driver is not in a clock locking state.

In an embodiment, the virtual feedback signal circuit is configured to output a virtual feedback signal substituting a normal state feedback signal output when the data driver is in a clock locking state.

In an embodiment, the virtual feedback signal includes a high level signal.

In an embodiment, a voltage of the virtual feedback signal is substantially equal to a voltage of a driving power.

According to some embodiments of the present invention, there is provided a display device including: a display panel; a plurality of data drivers configured to apply a data voltage to the display panel and to output feedback signals indicating a driving status; a shared back channel configured to receive the feedback signals applied from the plurality of data drivers; and a timing controller configured to receive the feedback signal and to apply a data signal to the plurality of data drivers, wherein the timing controller includes a switching block configured to substitute an input feedback signal with a virtual feedback signal indicating a normal driving state of the plurality of data drivers.

In an embodiment, the switching block is configured to substitute the input feedback signal with the virtual feedback signal when the display device in an inspection mode.

In an embodiment, the switching block is configured to substitute the input feedback signal with the virtual feedback signal when a low signal of the shared back channel is maintained for a reference time or longer.

In an embodiment, the timing controller is further configured to modulate clock data and image data to generate the data signal, and to transmit the data signal to the data driver.

In an embodiment, the data driver further includes a feedback signal circuit configured to receive the data signal output from the timing controller and to output the feedback signal.

In an embodiment, the feedback signal circuit is configured to output a normal state feedback signal to the shared back channel when the data driver is in a clock locking state.

In an embodiment, the feedback signal circuit is configured to output an error state feedback signal to the shared back channel when the data driver is not in a clock locking state.

The foregoing is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

The above and other features and aspects of the present disclosure of invention will be more clearly understood from the following detailed description taken in conjunction with the accompanying drawings, in which.

DETAILED DESCRIPTION

Figure 1:
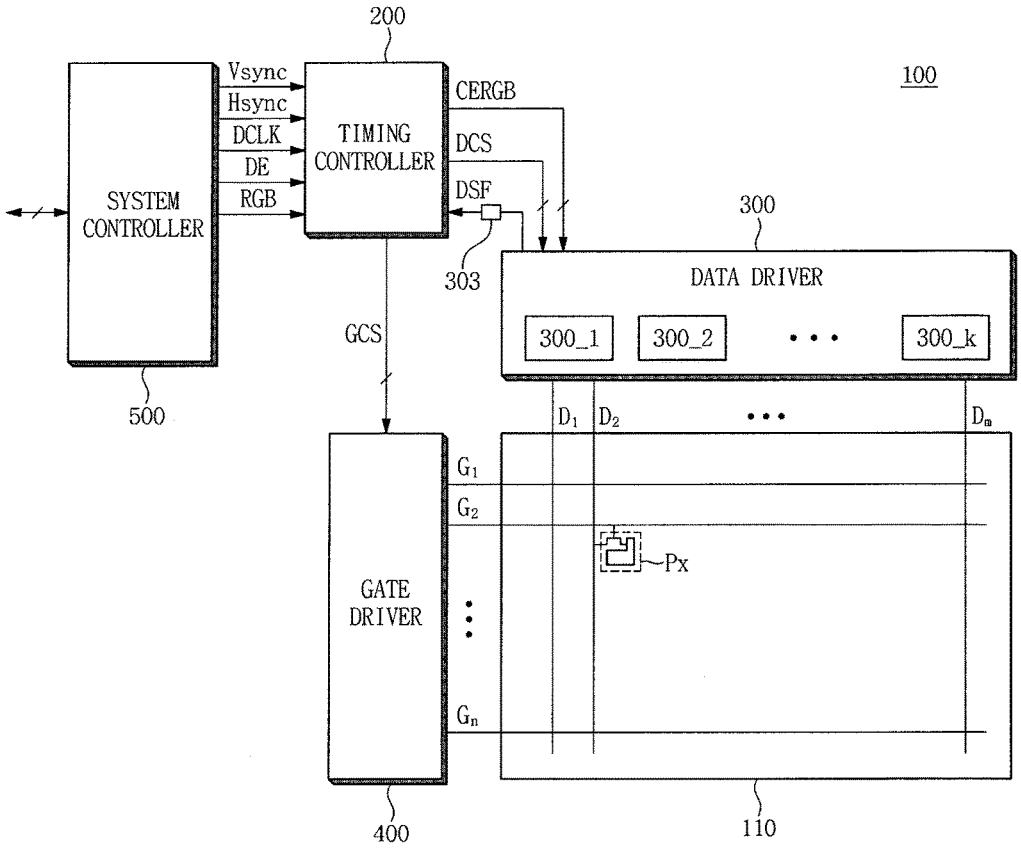
FIG. 1 is a schematic view illustrating a display device according to an exemplary embodiment of the present invention.

Hereinafter, embodiments of the present disclosure of invention will be described in more detail with reference to the accompanying drawings.

Although the present invention can be modified in various suitable manners and have several embodiments, specific embodiments are illustrated in the accompanying drawings and will be described in the specification. However, the scope of the embodiments of the present invention is not limited to the specific embodiments and should be construed as including all the changes, equivalents, and substitutions included in the spirit and scope of the present invention.

Some of the parts which are not associated with the description may not be provided in order to specifically describe embodiments of the present invention, and like reference numerals refer to like elements throughout the specification.

Hereinafter, configurations and features of the present invention will be described in detail with reference to exemplary embodiments of the present invention illustrated in the accompanying drawings.

FIG. 1 is a schematic view illustrating a display device 100 according to an exemplary embodiment of the present invention.

In reference to FIG. 1, the display device 100 includes a display panel 110, a timing controller 200, a data driver 300, a gate driver 400, and a system controller 500.

The display panel 110 includes a plurality of pixels Px at respective crossing regions of data lines D1 to Dm and gate lines G1 to Gn. A thin film transistor ("TFT") of one of the pixels Px (e.g., a pixel Px at a jth row and an ith column) applies a data voltage applied from a jth data line Dj to the pixel Px in response to a scan signal applied from an ith gate line Gi. The display panel may be an organic light emitting diode ("OLED") display, a liquid crystal display ("LCD") display device, a plasma display panel ("PDP"), or the like.

The timing controller 200 receives a vertical synchronization signal Vsync, a horizontal synchronization signal Hsync, a clock signal DCLK, a data enable signal DE, and data RGB applied from the system controller 500, to thereby generate a gate control signal GCS and a data control signal DCS for respectively controlling the gate driver 400 and the data driver 300. In addition, to transmit image data RGB to the data driver 300, the timing controller 200 modulates the image data RGB with clock data to convert the image data RGB into a clock embedded image signal CERGB (hereinafter, "data signal"), based on a data transmission interface.

The data driver 300 (which includes data drivers 300_1, 300_2, . . . , **300_*k*, k being an integer greater than 2) applies a data voltage to the display panel 110 in response to the data control signal DCS, and in response to the data signal CERGB, which is a modulated signal of the clock data and the image data, the data control signal DCS and the data signal CERGB being applied from the timing controller 200**.

The data driver 300 determines a data voltage corresponding to a gray level of the image data RGB, and applies the data voltage, which is an analog signal, to the data lines D1 to Dm. Further, a driver status feedback signal DSF (hereinafter, "feedback signal"), which indicates a driving status of the data driver 300, such as a state of clock locking, may be transmitted in the reverse direction to the timing controller 200 through a shared back channel (SBC) connected between the data driver 300 and the timing controller 200.

The gate driver 400 includes a plurality of scan drivers, and generates scan signals corresponding to respective scan lines G1, G2, . . . , Gn of the display panel 110 based on the gate control signal GCS applied from the timing controller 200. The generated scan signals are output to the pixels Px of the display panel 110 through respective scan lines G1, G2, . . . , Gn.

The system controller 500 applies the vertical synchronization signal Vsync, the horizontal synchronization signal Hsync, the clock signal DCLK, the data enable signal DE, the data RGB, and the like to the timing controller 200, and determines the driving operation of the display panel 110. Further, the system controller 500 receives an input, in terms of the driving operation of the display panel 110, applied from an external system.

Figure 2:
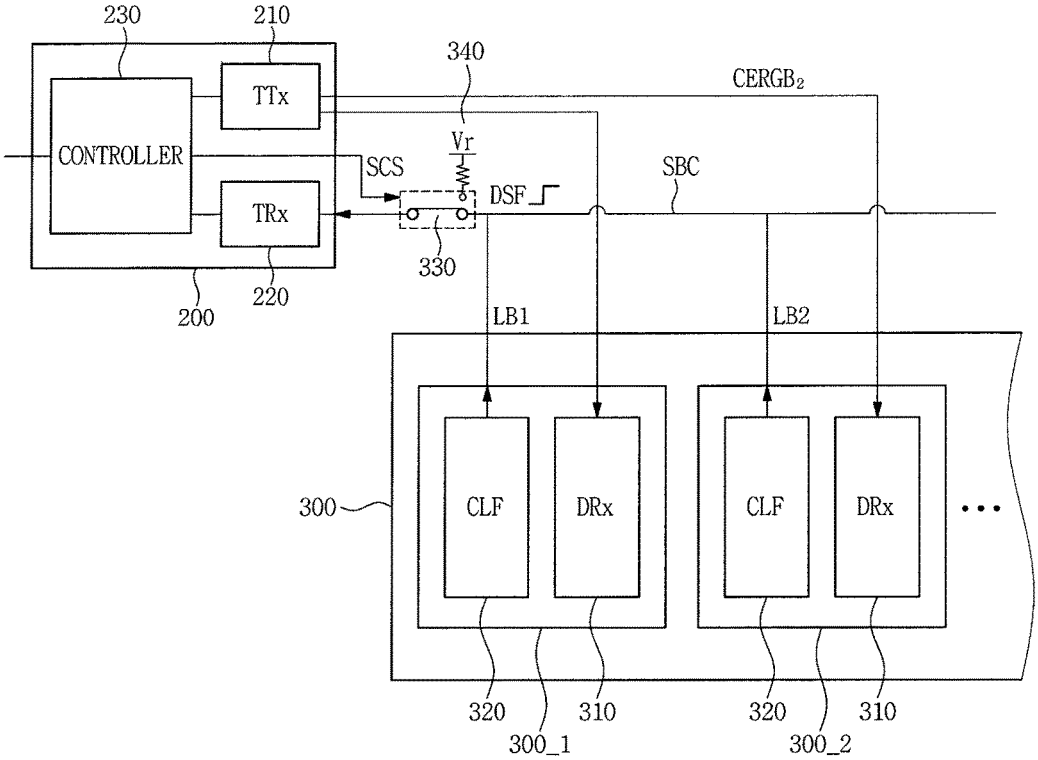
FIG. 2 is a schematic view illustrating a connecting configuration of data drivers according to an exemplary embodiment of the present invention.

FIG. 2 is a view illustrating a connecting configuration of the data drivers 300_1 and 300_2 according to an exemplary embodiment of the present invention.

In reference to FIG. 2, the timing controller 200 includes a controller 230, a signal transmitting unit (e.g., a signal transmitter) TTx 210 for transmitting a data signal, and a controller receiving unit (e.g., a controller receiver) TRx 220. The timing controller 200 is connected to a plurality of data drivers 300_1, 300_2, . . . **300_*k*. In addition, the timing controller 200 is connected to a shared back channel SBC connected to a local bus LB (e.g., local busses LB1, LB2, . . . LBk) of the data drivers 300** in common.

In reference to FIG. 2, the plurality of data drivers 300_1, 300_2, . . . **300_*k* may be connected to the signal transmitting unit TTx 210 of the timing controller 200 in a point-to-point method. An interface configured to transmit data between the timing controller 200 and the data drivers 300** is commonly referred to as an "intra panel interface." The intra panel interface may use one of a multi-drop method, such as reduced swing differential signaling (RSDS), and a point-to-point method, such as point-to-point differential signaling (PPDS) and advanced intra panel interface (AiPi).

A driver receiving unit (e.g., a driver receiver) DRx 310 of the data driver 300 receives a data signal transmitted from the timing controller 200. The driver receiving unit DRx 310 generates a reception clock signal based on periodic shift of the data signal. Further, the driver receiving unit DRx 310 samples the data signal based on the reception clock signal to restore the image data. The restored image data is converted into a data voltage by the data driver 300 to be applied to a corresponding one of the pixels Px at an input time of the scan signal.

In general, the data signal may not bear (e.g., contain) data information at the starting point of the signal, and may have an initial period that experiences periodic shift. The data signal input during such an initial period is referred to as a "pre-amble signal" or a "clock training signal", and the initial period is referred to as a "clock training period." In this regard, the clock training signal is a signal that indicates that the data signal including relevant information will be subsequently input after a set, or predetermined, number of bits or a set, or predetermined, time. Herein, the relevant information refers to image data RGB to be displayed on the display panel 110. A state in which a clock of the timing controller 200 and a clock of the driver receiving unit DRx 310 of the data driver 300 are synchronized through the clock training signal is referred to as a state of "clock locking." The state of clock locking is a state in which the data driver 300 is prepared to receive the relevant data. When the data driver 300 is in a data reception state, the data driver 300 transmits the feedback signal DSF having a high level (e.g., a logic high level) H to a corresponding local bus LB through a clock locking feedback unit (e.g., a clock locking feedback circuit) CLF 320. The respective local buses LB of the data drivers 300 are connected in common to the shared back channel SBC, and a signal of the shared back channel SBC is converted from a low level (e.g., a logic low level) L to a high level H when a respective one of the data drivers 300 connected to the shared back channel SBC is prepared to receive data (i.e., is in the clock locking state).

The controller receiving unit TRx 220 of the timing controller 200 receives the feedback signal DSF through the shared back channel SBC and a switching unit (e.g., a switch) 330. In a case where the feedback signal DSF input to the controller receiving unit TRx 220 is a high level H, the controller 230 verifies that a respective one of the data drivers 300 is prepared to receive the data, and then transmits an image data signal through the signal transmitting unit TTx 210. As described in the foregoing, a method of providing feedback in terms of the driving status of the plurality of data drivers 300 through a single shared line is referred to as a shared back channel (SBC) method.

A virtual feedback signal unit (e.g., a virtual feedback signal circuit) 340 outputs a virtual feedback signal VDSF indicating a locking status of the plurality of data drivers 300. The virtual feedback signal VDSF may have a voltage that may be recognized as a high level H in a digital circuit, and may be the same as a reference voltage Vr. In alternative exemplary embodiments, instead of employing the separate reference voltage Vr, a driving power (e.g., of a power terminal VDD) may be used as the virtual feedback signal VDSF. In some examples, the virtual feedback signal VDSF may be provided through an additional circuit configuration.

A switching unit 330 is connected to the timing controller 200. Accordingly, the switching unit 330 may selectively connect the shared back channel SBC and the virtual feedback signal unit 340 in response to the control signal applied from the timing controller 200. Further, the switching unit 330 may be an electronic control switch or a mechanical switch that may allow a user to switch the switching unit 330 on/off.

Figure 3:
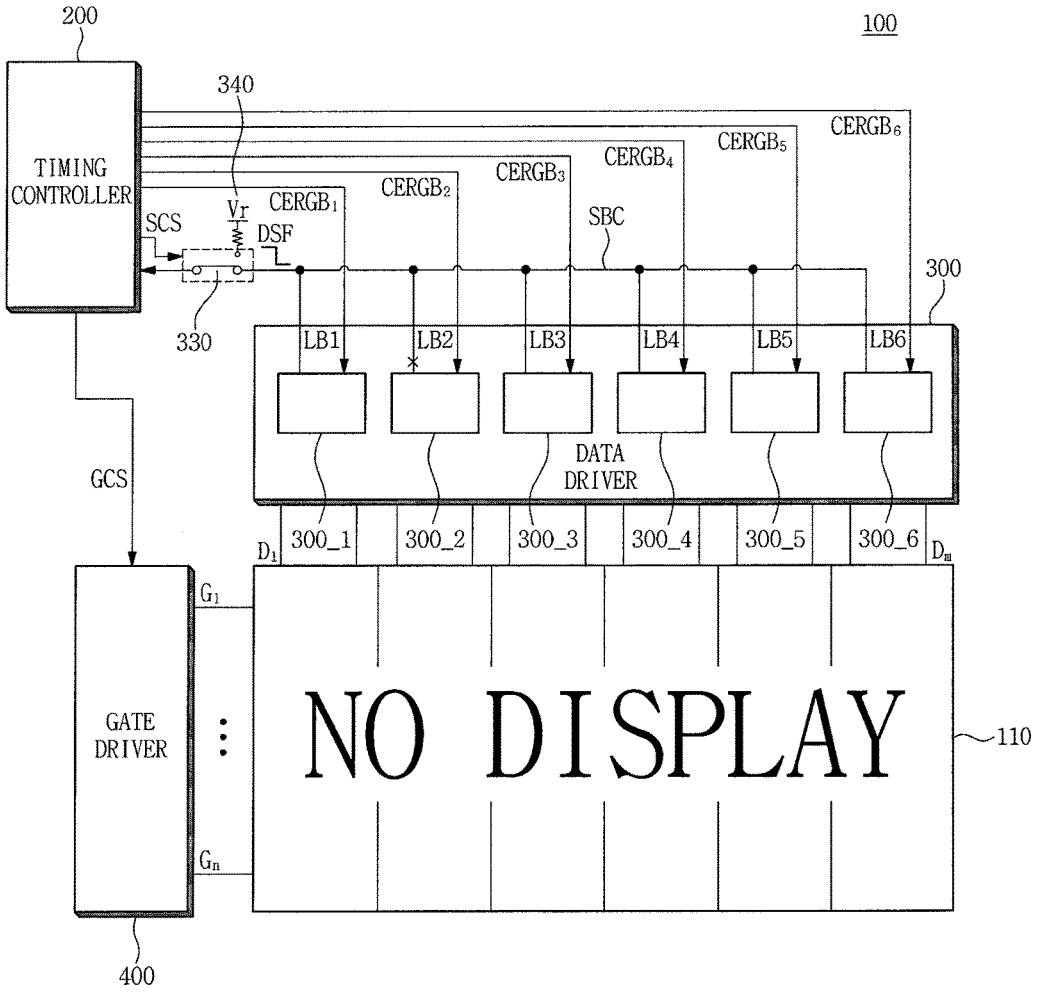
FIG. 3 is a schematic view illustrating a method of driving the display device according to an exemplary embodiment of the present invention.

FIG. 3 is a view illustrating a method of driving the display device 100 according to an exemplary embodiment of the present invention.

In reference to FIG. 3, the display panel 110 is connected to six data drivers 300_1, 300_2, . . . 300_6. However, embodiments of the present invention are not limited thereto, and any suitable number of data drivers may be used. The data drivers 300_1, 300_2, . . . 300_6 transmit the data voltage to respective divided portions of the display panel 110. The data drivers 300_1, 300_2, . . . 300_6 receive the data signals CERGB (e.g., data signals $CERGB_1$, $CERGB_2$, $CERGB_3$, $CERGB_4$, $CERGB_5$, and $CERGB_6$ shown in FIG. 3) applied from the timing controller 200, and transmit the feedback signals DSF, which indicate the state of the data drivers 300_1, 300_2, . . . 300_6, output from the clock locking feedback units CLF 320 to the shared back channel SBC.

FIG. 3 illustrates a case of experiencing an error in the second data driver 300_2 during the transmission of the data signal. For example, a second local bus LB2 may not output the feedback signal DSF having a high level H due to an error occurring in the second data driver 300_2, and may instead output the feedback signal DSF having a low level L.

The shared back channel SBC receives the feedback signal DSF from the plurality of data drivers 300 to transmit the feedback signal DSF to the timing controller 200. The shared back channel SBC may transmit a high level H only in a case where a respective one of the feedback signals DSF of the data drivers 300_1, 300_2, . . . 300_6 connected to the shared back channel SBC outputs a high level H. In a case where an error occurs in one of the data drivers 300_1, 300_2, . . . 300_6, thereby causing an output of a signal having a low level L, the shared back channel SBC transmits the signal having the low level L to the timing controller 200.

In the present exemplary embodiment, the high level H is representative of a normal driving state, and the low level L is representative of an error occurrence state. However, the criteria to define the normal driving state and the error occurrence state may be suitably modified based on a system design.

The switching unit 330 includes a three-terminal switching element, and the three terminals are respectively connected to the controller receiving unit TRx 220 of the timing controller 200, the shared back channel SBC, and the virtual feedback signal unit 340. In the normal mode, the switching unit 330 connects the controller receiving unit TRx 220 of the timing controller 200 to the shared back channel SBC.

The timing controller 200 verifies that an error occurs in the data driver 300 based on an input of the feedback signal DSF having a low level L through the shared back channel SBC. Once an error is detected, the timing controller 200 outputs a clock training signal for restoring the state of the data driver 300.

In a case where the error occurring in the second data driver 300_2 is a temporary error caused by, for example, electro static discharge ESD, the second data driver 302_2 may recover to the clocking locking state after performing clock training, and may output a high level H as the feedback signal DSF. In a case where the signal of the shared back channel SBC is converted to the high level H, the timing controller 200 outputs a data signal including image data, and the display panel 110 may display an image.

However, in a case where the error occurring in the second data driver 300_2 is an error caused by unrecoverable damage, the second data driver 300_2 may not recover into the normal driving state after performing clock training, and may output a signal having a low level L as the feedback signal DSF. In a case where the signal of the shared back channel SBC maintains the low level L, the timing controller 200 does not transmit image data to the data drivers 300.

Accordingly, the display device 100 may not display an image, and as a result, a user or a manufacturer may experience difficulty in analyzing and dealing with the malfunction.

Figure 4:
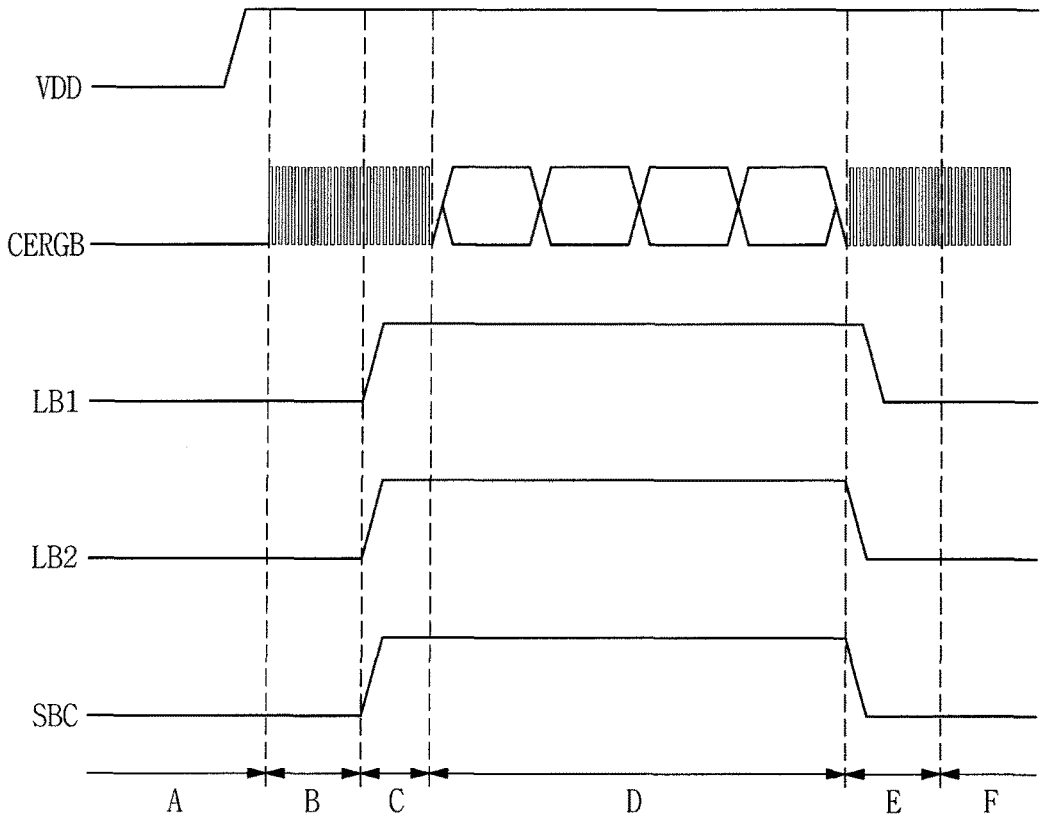
FIG. 4 is a waveform diagram illustrating a driving status of the display device of FIG. 3.

FIG. 4 is a waveform diagram illustrating a driving status of the display device of FIG. 3.

In reference to FIG. 4, in period A, which corresponds to an initial driving period of the display panel 110, a power is applied to a power terminal VDD.

In period B, the timing controller 200 outputs a data signal to the signal transmitting unit TTx 210. The data signal is provided as a clock embedded data (CED) signal, and conveys a clock training signal in the initial driving period. In the clock training period, the data drivers are synchronized with the clock of the data signal transmitted from the timing controller 200.

Period C corresponds to a clock locking period in which the data drivers 300 are synchronized with the clock after performing the clock training. In a case where the data drivers 300 are clock-locked, the clock locking feedback signal unit CLF 320 of the data driver 300 outputs a signal having a high level H to the local bus LB to feedback the state of the data driver 300. In a case where a respective one of the local buses LB outputs a signal having a high level H, the shared back channel (SBC) outputs a signal having a high level H. The controller receiving unit TRx 220 of the timing controller 200 is connected to the shared back channel SBC to receive the signal having the high level H.

In period D, the data signal CERGB, which is a modulated signal of the image data and the clock data, is output through the controller receiving unit TRx 220 of the timing controller 200. The data driver 300 restores the image data from the data signal CERGB in period D, and applies a data voltage to the display panel 110. That is, period D is a period in which an image is displayed on the display panel 110.

In period E, due to an error occurrence in, for example, the second data driver 300_2, the feedback signal DSF of the second local bus LB2 is converted into a low level L signal. Accordingly, the shared back channel SBC outputs a signal having a low level L. The controller receiving unit TRx 220 of the timing control 200 detects the feedback signal DFS having a low level L. The timing controller 200 outputs a clock training signal, and waits for an input of the feedback signal DSF having a normal state. As a result of the second local bus LB2 being converted into a clock training state, the other local buses LB1, LB3, LB4, LB5, and LB6 of other data drivers 300_1, 300_3, 300_4, 300_5, and 300_6 are converted into the low state L.

Period F illustrates a case in which an error of the second data driver 302_2 is maintained. The feedback signal DSF of the second local bus LB2 maintains the low level L, and the data transmission may not be recovered to initiate the image data state.

Figure 5:
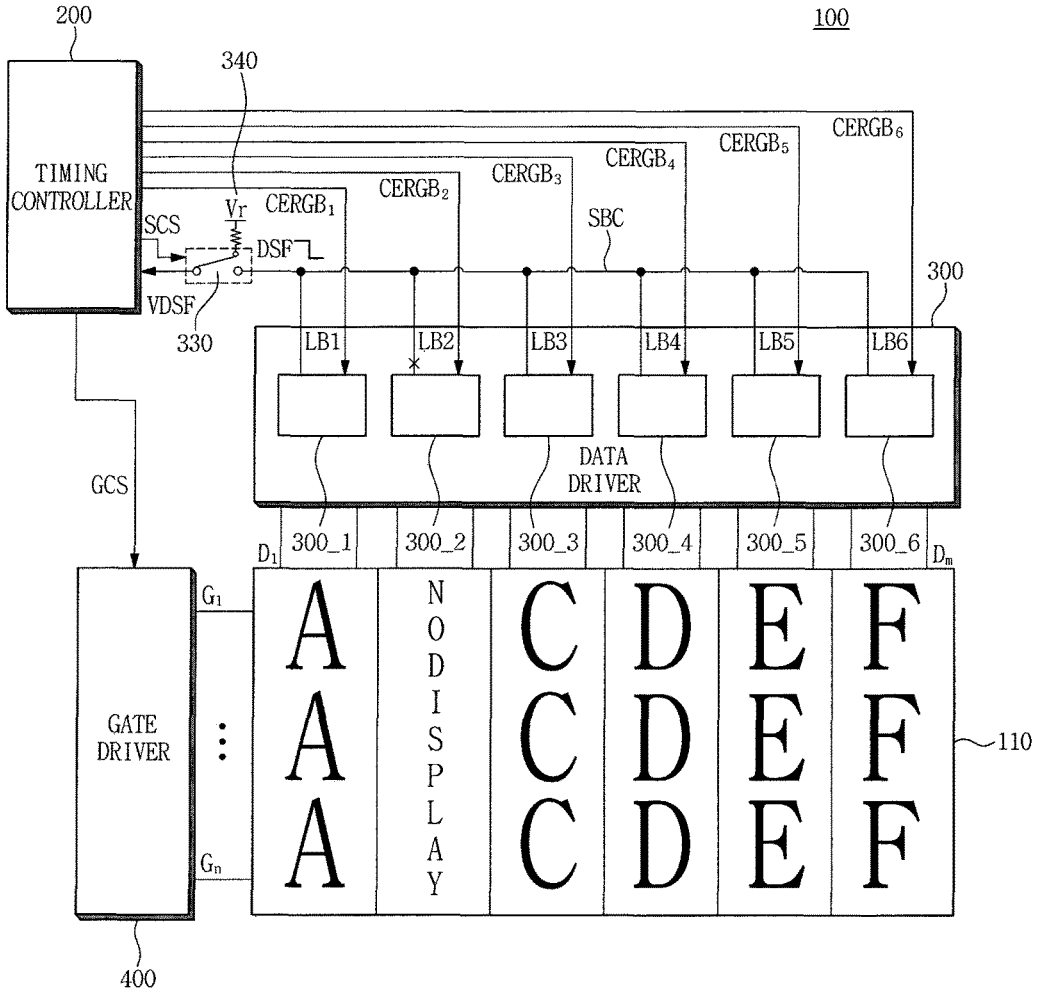
FIG. 5 is a schematic view illustrating a connecting configuration of data drivers according to another exemplary embodiment of the present invention.

FIG. 5 is a view illustrating a connecting configuration of the data drivers 300 according to another exemplary embodiment of the present invention.

The display device 100 may have a normal mode in which the display device 100 may be operated by a user in a normal state, and an inspection mode in which a user or a manufacturer inspects or repairs the display device 100.

In the normal mode, the switching unit 330 connects the timing controller 200 and the shared back channel SBC, as illustrated in FIG. 3. When an error occurs in the data driver 300, the timing controller 200 may not transmit the image data to the data driver 300 corresponding to the feedback signal DSF, and accordingly, the display panel 110 may not display an image.

In the inspection mode, the shared back channel-switch ("SBC switch) 330 disconnects the shared back channel SBC and the controller receiving unit TRx 220 of the timing controller 200, and connects the timing controller 200 and the virtual feedback signal unit 340. The virtual feedback signal unit 340 includes a reference voltage supply Vr having a voltage greater than, or equal to, a voltage recognized as a high voltage H by the timing controller 200. The reference voltage supply Vr may use a separate voltage supply, or may share the voltage of power terminal VDD. In a case where the display device 100 is set to be in the inspection mode, the timing controller 200 may switch on/off the switch by a control signal SCS. In addition, when the clock training period is maintained for a set, or predetermined, time (e.g., a second or more), the timing controller 200 verifies the presence of an error in the data driver 300, and outputs a control signal that may convert the switch connection state to connect the timing controller 200 and the virtual feedback signal unit 340.

The timing controller 200 verifies that a respective one of the data drivers 300 is in the clock locking state based on the virtual feedback signal VDSF having a high level H input to the controller receiving unit TRx 220. The timing controller 200 then outputs a data signal to the data drivers 300. As a result of experiencing an error, the second data driver 300_2 might not output a normal data voltage to the display panel 110. However, the other data drivers 300, except for the data driver 300_2 experiencing an error, output a normal data voltage to the respective assigned portions of the display panel 110.

Accordingly, although the data driver interface circuit having a feedback configuration using the shared back channel SBC is employed according to the present invention, the data driver 300_2 experiencing an error may be readily specified through the use of the virtual feedback signal VDSF.

According to the present exemplary embodiment, the switching unit 330 uses an electronic switch controlled by the timing controller 200 by way of example. In other embodiment, the switch may be switched on/off by a user. Further, the switching function may be embedded in the timing controller 200 as a function block.

Figure 6:
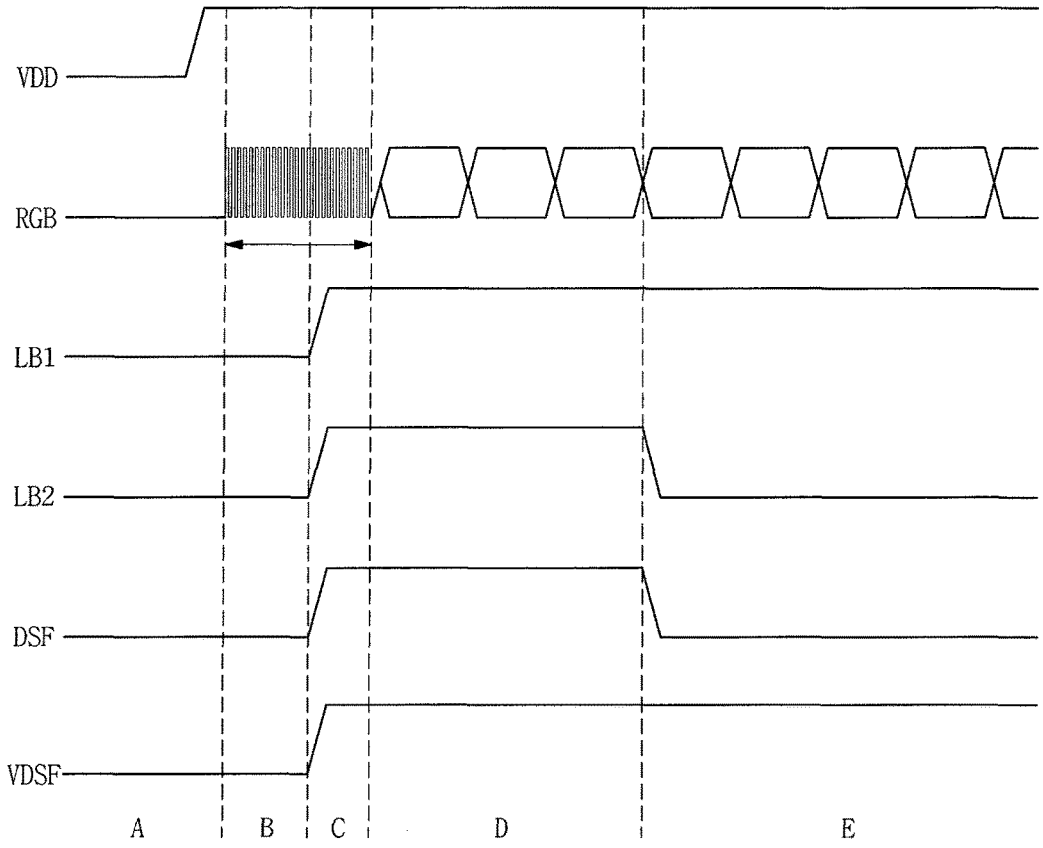
FIG. 6 is a waveform diagram illustrating a driving status of the display device of FIG. 5.

FIG. 6 is a waveform diagram illustrating a driving status of the display device of FIG. 5.

In reference to FIG. 6, the display device 100 is set to be in the inspection mode.

In period A, which corresponds to an initial driving period of the display panel 110, a power is applied to a power terminal VDD.

In period B, the timing controller 200 outputs a data signal to the signal transmitting unit TTx 210. The data signal is provided as a clock embedded data (CED) signal, and conveys a clock training signal in the initial driving period. In the clock training period, the data drivers 300 are synchronized with the clock of the data signal transmitted from the timing controller 200.

Period C corresponds to a clock locking period in which the data drivers 300 are synchronized with the clock after performing the clock training. In a case where the data drivers 300 are clock-locked, the feedback signal unit CLF 320 of the data driver 300 outputs a signal having a high level H to the local bus LB to feedback the state of the data driver 300. In a case where a respective one of the local buses LB outputs a high signal H, the shared back channel (SBC) outputs a signal having a high level H. The controller receiving unit TRx 220 of the timing controller 200 is connected to the shared back channel SBC to receive the signal having the high level H.

In period D, the data signal CERGB, which is a modulated signal of the image data and the clock data, is output through the controller receiving unit TRx 220 of the timing controller 200. The data driver 300 restores the image data from the data signal CERGB in period D, and applies a data voltage to the display panel 110. That is, period D is a period in which an image is displayed on the display panel 110.

In period E, due to an error occurrence in the second data driver 300_2, the feedback signal DSF of the second local bus LB2 is converted into a low level L signal. However, the connection between the timing controller 200 and the shared back channel SBC is severed by the switching unit 330, and the timing controller 200 is connected to the virtual feedback signal VDSF. The controller receiving unit TRx 220 of the timing controller 200 receives the virtual feedback signal VDSF having a high level H.

Because the timing controller 200 may not recognize the error occurrence of the second data driver 300_2, the timing controller 200 may output a normal data signal. Accordingly, the other data drivers 300, except for the second data driver 300_2, display an image on the display panel 110 in a normal state.

Figure 7:
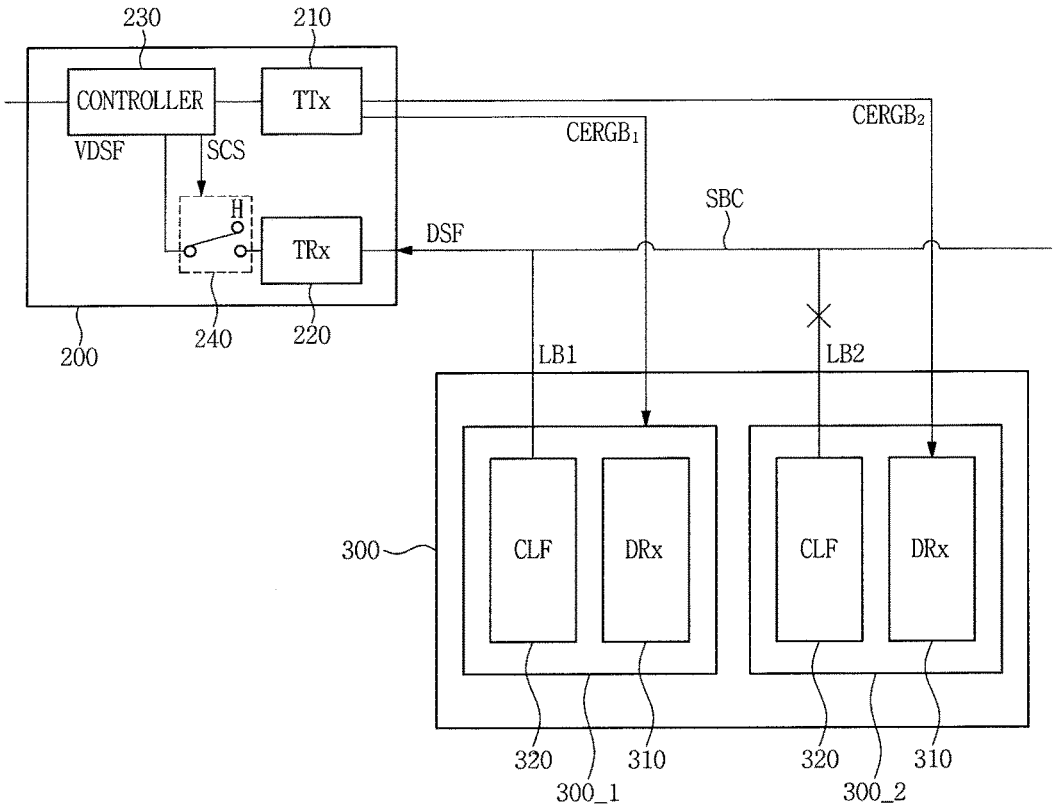
FIG. 7 is a schematic view illustrating a timing controller including a switching block according to yet another exemplary embodiment of the present invention.

FIG. 7 is a schematic view illustrating the timing controller 200 including a switching block 240 according to yet another exemplary embodiment of the present invention.

In reference to FIG. 7, the switching block 240 is a function block embedded in the timing controller 200. The switching block 240 may be disposed at an end portion of the controller receiving unit TRx 220, or may be disposed in the front portion of the controller receiving unit TRx 220. The switching block 240 may serve to substitute a low level L of the shared back channel SBC-input signal having with a high level H.

In a case where the display device 100 is in an inspection mode, the feedback signal DSF received through the controller receiving unit TRx 220 may be blocked by the switching block 240 embedded therein. The switching block 240 transmits the virtual feedback signal VDSF having a high level H to the controller 230 in response to a control signal SCS of the controller 230. The controller 230 transmits the control signal SCS to the signal transmitting unit TTx 210 to output the data signal to the data driver 300 in response to the virtual feedback signal VDSF having a high level H. The signal transmitting unit TTx 210 transmits the data signal CERGB to the data driver 300, and the data driver 300 outputs the data voltage to the display panel 110. In this case, the display panel 110 connected to the other data drivers 300, except for the second data driver 300_2 experiencing an error, may display a normal image.

Figure 8:
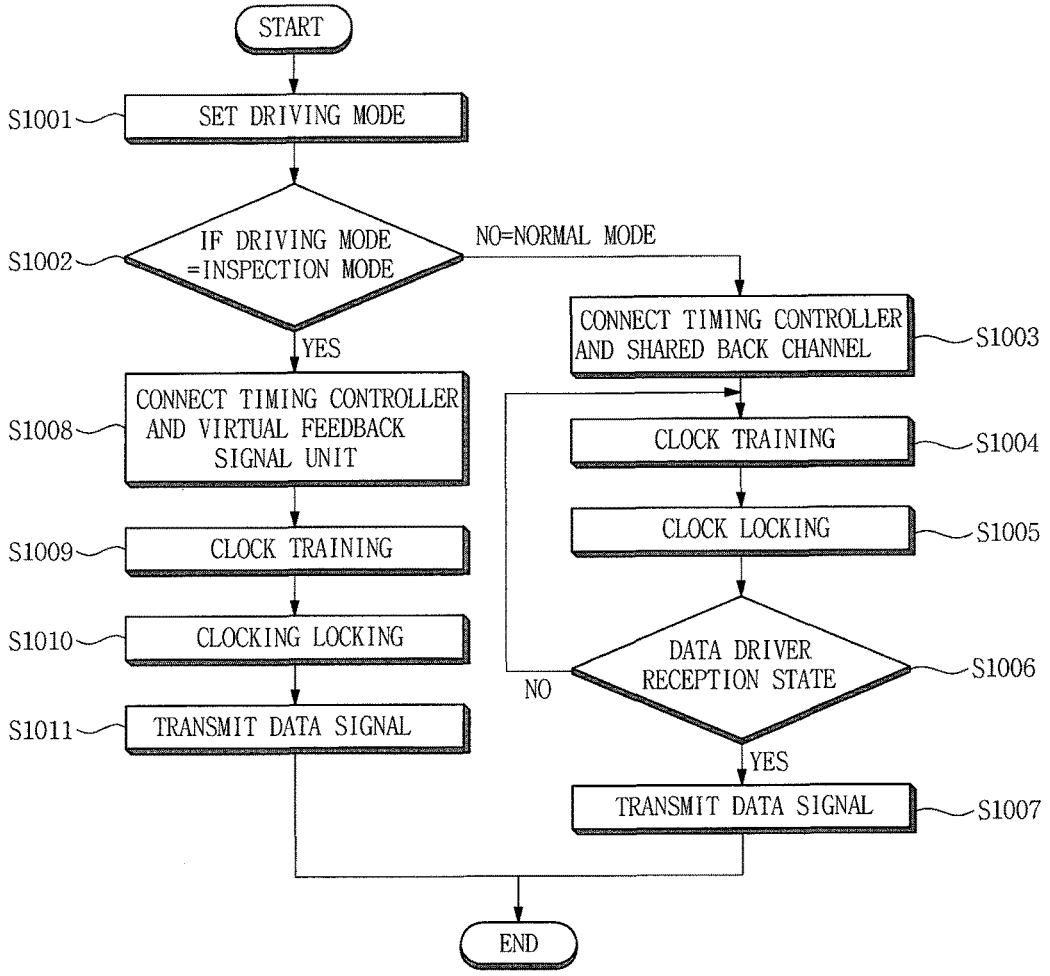
FIG. 8 is a flow diagram of a driving operation of a display device according to an exemplary embodiment of the present invention.

FIG. 8 is a flow diagram of a driving operation of a display device according to an exemplary embodiment of the present invention.

In reference to FIG. 8, in act S1001, the timing controller 200 sets a normal mode and an inspection mode based on a value input by a user.

In act S1002, the timing controller 200 determines whether the driving mode is the inspection mode. When the driving mode is not the inspection mode, it is assumed that the driving mode is the normal mode.

In act S1003, when the driving mode is the normal mode, the switching unit 330 connects the timing controller 200 and the shared back channel SBC.

In act S1004, the signal transmitting unit TTx 210 of the timing controller 200 outputs a clock training signal to the data driver 300.

In act S1005, The data driver 300 attempts clock locking based on the received clock training signal. The data driver 300 provides feedback of the clock locking state to the timing controller 200 through the shared back channel SBC.

In act S1006, in response to the feedback signal being applied from the shared back channel SBC, the timing controller 200 proceeds to a transmission act of the data signal including image data (S1007) when the clock locking is completed. However, the timing controller 200 proceeds to the clocking training act (S1004) when the clock locking (S1005) fails.

In act S1007, the timing controller 200 transmits the data signal CERGB including the image data to the data driver 300.

In act S1008, in a case of the inspection mode, based on the determination in act S1002 in which the timing controller 200 determines whether the driving mode is the normal mode or the inspection mode, the switching unit 330 is controlled to connect the timing controller 200 to a terminal of the reference voltage Vr of the virtual feedback signal unit 340.

In act S1009, the signal transmitting unit TTx 210 of the timing controller 200 outputs the clock training signal to the data driver 300.

In act S1010, the data driver 300 attempts clock locking based on the received clock training signal. In this step, the virtual feedback signal VDSF of the virtual feedback signal unit 340 is transmitted to the timing controller 200, and thereby the timing controller 200 verifies that the clock locking is completed.

In act S1011, the timing controller 200 transmits the data signal CERGB including the image data to the data driver 300.

Based on the driving sequence described in the foregoing, although an error occurs in one or more of the data drivers, a portion of the screen is displayed through the data drivers operated in the normal state. Accordingly, the data driver experiencing an error may be verified.

As set forth above, according to embodiments of the present invention, a data driver that experiences an error may be verified among a plurality of data drivers.

It will be understood that, although the terms "first", "second", "third", etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section discussed below could be termed a second element, component, region, layer or section, without departing from the spirit and scope of the inventive concept.

The terminology used herein is for the purpose of describing particular embodiments and is not intended to be limiting of the inventive concept. As used herein, the singular forms "a" and "an" are intended to include the plural forms as well, unless the context clearly indicates otherwise. It will be further understood that the terms "include," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Further, the use of "may" when describing embodiments of the inventive concept refers to "one or more embodiments of the inventive concept." Also, the term "exemplary" is intended to refer to an example or illustration.

It will be understood that when an element or layer is referred to as being "connected to" another element or layer, it can be directly connected to the other element or layer, or one or more intervening elements or layers may be present. When an element or layer is referred to as being "directly connected to" another element or layer, there are no intervening elements or layers present.

As used herein, the terms "use," "using," and "used" may be considered synonymous with the terms "utilize," "utilizing," and "utilized," respectively.

The display device and/or any other relevant devices or components according to embodiments of the present invention described herein may be implemented using any suitable hardware, firmware (e.g. an application-specific integrated circuit), software, or a suitable combination of software, firmware, and hardware. For example, the various components of the display device may be formed on one integrated circuit (IC) chip or on separate IC chips. Further, the various components of the display device may be implemented on a flexible printed circuit film, a tape carrier package (TCP), a printed circuit board (PCB), or formed on a same substrate. Further, the various components of the display device may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the scope of the exemplary embodiments of the present invention.

From the foregoing, it will be appreciated that various embodiments in accordance with the present disclosure have been described herein for purposes of illustration, and that various suitable modifications may be made without departing from the scope and spirit of the present teachings, as defined by the appended claims and equivalents thereof. Accordingly, the various embodiments disclosed herein are not intended to be limiting of the true scope and spirit of the present teachings.

What is claimed is:

1. A display device comprising:

a display panel;

a plurality of data drivers configured to apply a data voltage to the display panel and to output a feedback signal indicating a driving status;

a shared back channel configured to receive the feedback signal from the plurality of data drivers;

a timing controller configured to apply a data signal to the plurality of data drivers;

a virtual feedback signal circuit configured to output a virtual feedback signal indicating a normal driving state of the plurality of data drivers to the timing controller; and a switch connected to the timing controller, and configured to selectively connect the shared back channel or the virtual feedback signal circuit to the timing controller, wherein the timing controller is configured to apply the data signal to the plurality of data drivers in accordance with the virtual feedback signal from the switch, and wherein the virtual feedback signal comprises only a high level signal.

2. The display device of claim 1, wherein the timing controller is further configured to output, to the switch, a control signal for connecting the switch to the virtual feedback signal circuit when the display device is in an inspection mode.

3. The display device of claim 2, wherein the timing controller is configured to transmit, to the data drivers, the data signal comprising modulating clock data and image data.

4. The display device of claim 3, wherein each of the data drivers further comprises a feedback signal circuit configured to receive the data signal output from the timing controller and to output the feedback signal.

5. The display device of claim 4, wherein the feedback signal circuit is configured to output a normal state feedback signal to the shared back channel when a corresponding data driver of the data drivers is in a clock locking state.

6. The display device of claim 4, wherein the feedback signal circuit is configured to output an error state feedback signal to the shared back channel when a corresponding data driver of the data drivers is not in a clock locking state.

7. A display device comprising:

a display panel;

a plurality of data drivers configured to apply a data voltage to the display panel and to output a feedback signal indicating a driving status;

a shared back channel configured to receive the feedback signal from the plurality of data drivers;

a virtual feedback signal circuit configured to output a virtual feedback signal indicating a normal driving state of the plurality of data drivers;

a timing controller configured to apply a data signal to the plurality of data drivers; and a switch connected to the timing controller, and configured to selectively connect the shared back channel or the virtual feedback signal circuit to the timing controller, wherein the timing controller is further configured to output, to the switch, a control signal for connecting the switch to the virtual feedback signal circuit when a low signal of the shared back channel is maintained for a reference time or longer.

8. A display device comprising:

a display panel;

a plurality of data drivers configured to apply a data voltage to the display panel and to output a feedback signal indicating a driving status;

a shared back channel configured to receive the feedback signal from the plurality of data drivers;

a virtual feedback signal circuit configured to output a virtual feedback signal indicating a normal driving state of the plurality of data drivers;

a timing controller configured to apply a data signal to the plurality of data drivers; and a switch connected to the timing controller, and configured to selectively connect the shared back channel or the virtual feedback signal circuit to the timing controller, wherein the virtual feedback signal circuit is configured to output a virtual feedback signal substituting a normal state feedback signal output when a data driver of the data drivers is in a clock locking state.

9. The display device of claim 8, wherein the virtual feedback signal comprises a high level signal.

10. The display device of claim 8, wherein a voltage of the virtual feedback signal is substantially equal to a voltage of a driving power.

11. A display device comprising:

a display panel;

a plurality of data drivers configured to apply a data voltage to the display panel and to output feedback signals indicating a driving status;

a shared back channel configured to receive the feedback signals applied from the plurality of data drivers; and a timing controller configured to receive the feedback signals and to apply a data signal to the plurality of data drivers, wherein the timing controller comprises a switching block configured to substitute an input feedback signal with a virtual feedback signal indicating a normal driving state of the plurality of data drivers when a data driver of the data drivers is in a clock locking state, wherein the virtual feedback signal comprises only a high level signal.

12. The display device of claim 11, wherein the switching block is configured to substitute the input feedback signal with the virtual feedback signal when the display device in an inspection mode.

13. The display device of claim 12, wherein the switching block is configured to substitute the input feedback signal with the virtual feedback signal when a low signal of the shared back channel is maintained for a reference time or longer.

14. The display device of claim 12, wherein the timing controller is further configured to modulate clock data and image data to generate the data signal, and to transmit the data signal to the data driver.

15. The display device of claim 14, wherein the data driver further comprises a feedback signal circuit configured to receive the data signal output from the timing controller and to output the feedback signals.

16. The display device of claim 15, wherein the feedback signal circuit is configured to output a normal state feedback signal to the shared back channel when the data driver is in a clock locking state.

17. The display device of claim 15, wherein the feedback signal circuit is configured to output an error state feedback signal to the shared back channel when the data driver is not in a clock locking state.

* * * * *